United States Patent [19]

Schneiter et al.

[11] Patent Number: 4,547,235

[45] Date of Patent: Oct. 15, 1985

[54] GAS GENERANT FOR AIR BAG INFLATORS

[75] Inventors: Fred E. Schneiter, North Ogden; Allan J. McDonald, Pleasant View, both of Utah

[73] Assignee: Morton Thiokol, Inc., Chicago, Ill.

[21] Appl. No.: 620,653

[22] Filed: Jun. 14, 1984

[51] Int. Cl.[4] ..... C06B 35/00

[52] U.S. Cl. ..... 149/35; 149/61; 149/72; 252/350; 280/728; 280/737; 280/741; 423/351

[58] Field of Search ..... 149/35, 61, 72; 423/351; 252/350; 280/728, 737, 741

[56] References Cited

U.S. PATENT DOCUMENTS

| | | | |
|---|---|---|---|
| 2,981,616 | 4/1961 | Boyer | 52/0.5 |
| 3,361,602 | 1/1968 | Leslie | 149/24 |
| 3,741,585 | 6/1973 | Hendrickson et al. | 280/150 AB |
| 3,775,199 | 11/1973 | Boyars et al. | 149/35 |
| 3,785,674 | 1/1974 | Poole et al. | 280/150 AB |
| 3,797,854 | 3/1974 | Poole et al. | 280/150 AB |
| 3,883,373 | 5/1975 | Sidebottom | 149/35 |
| 3,895,098 | 7/1975 | Pietz | 423/351 |
| 3,931,040 | 1/1976 | Breazeale | 252/188.3 R |
| 3,947,300 | 3/1976 | Passaver et al. | 149/35 |
| 4,021,275 | 5/1977 | Kishi et al. | 149/35 |
| 4,203,787 | 5/1980 | Kirchoff et al. | 149/35 |
| 4,296,084 | 10/1981 | Adams et al. | 423/351 |
| 4,376,002 | 3/1983 | Utracki | 149/35 |

*Primary Examiner*—Stephen J. Lechert, Jr.

*Attorney, Agent, or Firm*—Gerald K. White; Richard J. Sheridan

[57] ABSTRACT

In accordance with the present invention there are provided gas generating compositions comprising sodium azide, silicon dioxide, potassium nitrate, molybdenum disulfide and sulfur.

11 Claims, No Drawings

GAS GENERANT FOR AIR BAG INFLATORS

BACKGROUND OF THE INVENTION

1. Field of the Invention

This invention relates generally to gas generating compositions and, in particular, to such compositions which are suitable for inflating cushions (commonly known as "crash bags" or "air bags") in vehicle restraint systems of the types which utilize such a cushion to protect vehicle occupants upon sudden stopping or deceleration of the vehicle in which they are riding.

2. Description of the Prior Art

The use of protective gas inflated bags to cushion vehicle occupants in a crash situation is now widely known. In the first devised systems of this type, a quantity of compressed, stored gas was employed to inflate a crash bag which upon inflation was imposed between the occupant and the windshield, steering wheel and dashboard of the vehicle. However, because of the bulk of the apparatus, its generally slow reaction time and its maintenance difficulties, this stored pressurized gas system has now largely been superseded by systems which generate gases by the ignition of a chemical gas generating pyrotechnic composition.

A large number of quick-burning gas generating compositions have been developed for crash bags, although many tend to be deficient in one respect or another. Consequently, the industry has attempted to develop a gas generating composition which combines the essential features of a short induction period, a burn rate which is rapid but without any explosive effect, a high bulk density so that only a small amount of composition is required to produce large amounts of gas; the production of only non-toxic gases so that vehicle occupants are not endangered in the event of a leak or during the venting of the crash bag after inflation; the production of gases at a relatively low temperature so that damage to the crash bag is minimized and vehicle occupants are not burned; and good filterability of the reaction products so that hot solid residue cinders are easily removed from the gas stream. In addition, the gas generator composition must be readily formable into the required shape, and must be physically strong as well as chemically and physically stable so that long periods of storage can be attained under a under a wide range of temperature cycling and shock. While some of these desirable properties are found in known chemical gas generators, heretofore it has not been possible to provide compositions which satisfy all of the industry requirements.

One of the most common types of chemical gas generating compositions comprise a mixture or blend of an alkali metal or alkaline earth metal azide, usually sodium azide, and an oxidizer, commonly a metal oxide. In some cases the metal oxide is replaced by a metallic chloride, nitrate, sulfate, peroxide, perchloride, or other oxidizer.

SUMMARY OF THE INVENTION

In accordance with the present invention there are provided gas generating compositions comprising sodium azide, silicon dioxide, potassium nitrate, molybdenum disulfide and sulfur. The gas generating compositions of this invention are capable of producing large amounts of nitrogen gas in a short period of time and are, therefore, useful for inflating automobile crash bags. The gas generating compositions of this invention possess the highly desirable properties of being readily formable into a desired shape, e.g., pellet; improved safety in processing; igniting easily yet with excellent ignition stability, i.e. ignition of the gas generating compositions is reproducible and consistent over a wide temperature range; producing low amounts of caustic products in the combustion effluent; and producing low amounts of particulates in the combustion effluent.

DESCRIPTION OF THE PREFERRED EMBODIMENT

The gas generating compositions of the present invention comprise:

(1) sodium azide
(2) silicon dioxide
(3) potassium nitrate
(4) molybdenum disulfide
(5) sulfur The above components of the gas generating compositions of this invention may be employed in the amounts shown in Table I below wherein all percentages are by weight based on the total weight of the composition.

TABLE I

| COMPOUND | WT % |
|---|---|
| Sodium Azide | 60–68 |
| Silicon Dioxide | 18–24 |
| Potassium nitrate | 8–24 |
| Molybdenum disulfide | 2–4 |
| Sulfur | 2–4 |

The preferred gas generating compositions of this invention contain the ingredients listed in Table II where all percentages are by weight based on total composition weight.

TABLE II

| INGREDIENT | APPROX. WT % |
|---|---|
| Sodium azide | 64 |
| Silicon dioxide | 22 |
| Potassium nitrate | 8 |
| Molybdenum disulfide | 4 |
| Sulfur | 2 |

The particle sizes of the above components are not critical, the commercially available materials sized as powders or small crystals being suitable.

The sodium azide is, of course, the nitrogen source in the gas generating composition and provides a high yield of nitrogen with low heat release. The silicon dioxide reacts with the potassium (from potassium nitrate) and sodium (from sodium azide) generated upon combustion to form silicates with them in the form of an innocuous klinker. This reduces the amount of caustic or potentially caustic materials in the effluent to a quite unexpectedly low level. This significantly reduces the hazard from possible exposure by vehicle occupants to the gas generator combustion products, reduces the level of filtration which is ordinarily required in crash bag inflators, improves the effluent gas quality and odor, and probably obviates the need of a neutralizer which is often required in crash bag inflators to control the pH of the gas generator exhaust products. The potassium nitrate and sulfur provide both control and stabilization of the burn rate. The potassium nitrate serves another function, too. The sodium azide and silicon dioxide do not adequately sustain combustion of the gas generating composition by themselves. However, the addition of the potassium nitrate to the composition solves this problem and permits the composition to readily sustain combustion. The sulfur, in particular, aids ignition of the gas generating composition. The molybdenum disulfide provides the two-fold advantage of improving the processability, e.g., pelletization, of the composition and providing a cooling effect upon combustion. Finally, it has been discovered that the burn rate of the gas generating composition can be readily controlled by adjusting the ratio of silicon dioxide to potassium nitrate without adversely effecting the other gas generant performance criteria. This manner of controlling the burn rate of the gas generating compositions is highly preferrable to the common method of adjusting the particle sizes of the various components. Particle size adjustment requires special equipment and merely adds to the time and expense of preparing the gas generating compositions. On the contrary, the present invention permits adjustment of the burn rate by simply changing the ratio of silicon dioxide to potassium nitrate. This, of course, requires no special equipment, nor does it significantly change the procedure by which the gas generating compositions are prepared.

The gas generating compositions of this invention are easily prepared by simply mixing together the components in a common dry powder blender until a homogeneous mixture is formed. The resulting mixture is then pelletized in a common pressure type pelletizer. One particular advantage of the gas generating composition of this invention is that they overcome problems in pelletizing encountered with some prior art gas generating compositions and, thus, make the pelletization procedure much easier.

The thus formed pellets are utilized in a wide variety of well known gas generator mechanisms such as, for example, that disclosed by G. V. Adams and F. E. Schneiter in U.S. Pat. No. 4,296,084.

The following examples illustrate the present invention. Unless otherwise indicated, in the examples and throughout this specification all percentages are by weight based on total composition weight.

EXAMPLE 1

This example illustrates a typical procedure by which the gas generating compositions of this invention may be prepared.

Sodium azide, molybdenum disulfide and silicon dioxide (in the desired amounts) were blended with water to form a slurry. Potassium nitrate and sulfur (also in the desired amounts) were then added to the slurry and the resulting mixture thoroughly mixed. The resulting slurry was then passed through a colloid mill (wet grind), after which it was dried in a spray drier to produce homogeneous granules.

The thus-produced granules were then used as feed stock for a rotary, multi-station tablet press in which the feed stock was pelletized into tablet form.

EXAMPLES 2-4

These examples illustrates the control over the burn rate of the gas generating compositions of this invention which can be achieved by adjusting the ratio of silicon dioxide to potassium nitrate.

Pellets are prepared as described in Example 1 from the following formulations which produced the performance characteristics indicated upon combustion:

| INGREDIENT | EX. NO. 2 | COMPARATIVE EX. NO. 3 | COMPARATIVE EX. NO. 4 |
|---|---|---|---|
| Sodium azide (10-20 microns) | 60% | 60% | 60% |
| Molybdenum disulfide (Tech. grade, unground) | 4% | 4% | 4% |
| Potassium nitrate (unground or ground to 15-20 microns) | 17% | 12% | 18% |
| Silicon dioxide (325 mesh) | 17% | 24% | 18% |
| Sulfur (unground) | 2% | — | — |
| Combustion temp. (°K.) | 1963 | 1940 | 1939 |
| Conversion to gas (% by wt.) | 41.1 | 40.0 | 41.3 |
| Causticity factor[1] | 10.9 | 6.26 | 9.8 |
| Burn rate (in/sec @ 1000 psi) | 1.6 | 1.0 | 1.4 |

[1]Caustic products in residue equivalent to percent weight in sodium.

EXAMPLES 5-8

These examples illustrate the reduction in caustic combustion products from the gas generating compositions of this invention.

Pellets are prepared as in Example 1 from the following formulations which produced the performance characteristics indicated upon combustion.

| INGREDIENT | EX. NO. 5 | COMPARATIVE EX. NO. 6 | COMPARATIVE EX. NO. 7 | COMPARATIVE EX. NO. 8 |
|---|---|---|---|---|
| Sodium azide | 60% | 68% | 60% | 66% |
| Molbdenum disulfide | 4% | 30% | — | 2% |
| Potassium nitrate | 17% | — | 20% | — |
| Silicon dioxide | 17% | — | 20% | — |
| Sulfur | 2% | 2% | — | 2% |
| $Fe_2O_3$ | — | — | — | 30% |
| Combustion temp. (°K.) | 1963 | 1592 | 2009 | 1300 |
| Conversion to gas (% by wt.) | 41.1 | 42.8 | 42.15 | 42.26 |
| Causticity factor | 10.9 | 24.8 | 10.15 | 23.49 |

We claim:

1. A gas generant composition for generating an airbag inflating gas upon combustion comprising:

a. about 60% to about 68% sodium azide, b. about 18% to about 24% silicon dioxide c. about 8% to about 20% potassium nitrate d. about 2% to about 20% molybdenum disulfide e. about 2% to about 4% sulfur, wherein said silicon dioxide and said potassium nitrate are provided in a gas generant burn rate controlling ratio of silicon dioxide to potassium nitrate of from 1:1 to 2:1, wherein said silicon dioxide and said potassium nitrate provide for the reduction of potentially caustic materials in said gas, the silicon dioxide reacting with the potassium from said potassium nitrate and sodium from said sodium azide generated upon combustion to form silicates in the form of an innocuous klinker; and wherein all percentages are by weight based on total composition weight.

2. A gas generating composition according to claim 1 which contains about 64% sodium azide.

3. A gas generating composition according to claim 1 which contains about 22% silicon dioxide.

4. A gas generating composition according to claim 1 which contains about 8% potassium nitrate.

5. A gas generating composition according to claim 1 which contains about 4% molybdenum disulfide.

6. A gas generating composition according to claim 1 which contains about 2% sulfur.

7. A gas generating composition according to claim 1 which contains:

a. about 64% sodium azide,
b. about 22% silicon dioxide,
c. about 8% potassium nitrate,
d. about 4% molybdenum disulfide and
e. about 2% sulfur.

8. An air bag inflating composition, comprising the reaction products formed by combusting a composition containing:

a. about 60% to about 68% sodium azide, b. about 18% to about 24% silicon dioxide c. about 8% to about 20% potassium nitrate d. about 2% to about 20% molybdenum disulfide e. about 2% to about 4% sulfur, wherein said silicon dioxide and said potassium nitrate are provided in a gas generant burn rate controlling ratio;

wherein said silicon dioxide and said potassium nitrate provide for the reduction of potentially caustic materials in the effluent, the silicon dioxide reacting with the potassium from said potassium nitrate and sodium from said sodium azide generated upon combustion to form silicates in the form of an innocuous klinker; and wherein all percentages are by weight based on total composition weight.

9. The composition of claim 8, wherein said gas generant burn rate controlling ratio of silicon dioxide to potassium nitrate falls within the range of 1:1 to 2:1.

10. A method for inflating an airbag providing an airbag providing a gas generant composition for said airbag said gas generant composition including about 60% to about 68% sodium azide; about 2% to about 20% molybdenum disulfide; about 2–4% sulfur; about 18% to about 24% silicon dioxide; and about 8% to about 20% potassium nitrate; said silicon dioxide and potassium nitrate being present in a burn generant rate controlling ratio of silicon dioxide to potassium nitrate; wherein said silicon dioxide and said potassium nitrate provide for the reduction of potentially caustic materials in the effluent, the silicon dioxide reacting with the potassium from said potassium nitrate and sodium from said sodium azide generated upon combustion to form silicates in the form of an innocuous klinker; and igniting said gas generant composition, whereby said gas generant composition is combusted to generate a gas for inflating said airbag.

11. The method of claim 10, wherein the ratio of silicon dioxide to potassium nitrate falls within the range of from 1:1 to 2:1.

* * * * *